US005461767A

United States Patent [19]

Okubo

[11] Patent Number: 5,461,767

[45] Date of Patent: Oct. 31, 1995

[54] MANUFACTURING METHOD OF METAL BELLOWS

[75] Inventor: Kiyoshi Okubo, Maebashi, Japan

[73] Assignee: NSK Ltd., Tokyo, Japan

[21] Appl. No.: 203,036

[22] Filed: Feb. 28, 1994

[30] Foreign Application Priority Data

Nov. 26, 1993 [JP] Japan ..... 5-296406

[51] Int. Cl.[6] ..... B23P 17/00

[52] U.S. Cl. ..... 29/454; 29/897.2; 72/369

[58] Field of Search ..... 29/454, 890.144, 29/234, 237, 238, 282, 516, 897.2; 72/369

[56] References Cited

U.S. PATENT DOCUMENTS

| | | | |
|---|---|---|---|
| 1,151,777 | 8/1915 | Fulton | 29/890.144 |
| 2,083,943 | 6/1937 | Clifford et al. | 113/116 |
| 2,232,657 | 2/1941 | Davis | 29/890.144 X |
| 2,954,064 | 9/1960 | Mers | 29/454 |
| 3,457,762 | 7/1969 | Gain | 72/367 |
| 3,608,182 | 4/1969 | Hughes et al. | 29/454 |
| 3,699,624 | 10/1972 | DeGain | 29/155 |

FOREIGN PATENT DOCUMENTS

| | | |
|---|---|---|
| 2037323 | 3/1971 | Germany . |
| 2831202 | 1/1980 | Germany . |
| 26-2212 | 4/1951 | Japan . |
| 56-68535 | 6/1981 | Japan . |
| 57-199526 | 12/1982 | Japan . |
| 63-157724 | 6/1988 | Japan . |
| 64-2733 | 1/1989 | Japan . |
| 4-172132 | 6/1992 | Japan . |

OTHER PUBLICATIONS

M. Namaura, Nikkan Kogygo Shinbun Publication, "Working Method of Piping", p. 96.

Patent Abstracts of Japan, vol. 16, No. 474 (M-1319) 2 Oct. 1992 (JP-A-04 172 132).

Patent Abstracts of Japan, vol. 13, No. 163 (M-816) 19 Apr. 1989 (JP-A-64 002 733).

*Primary Examiner*—Timothy V. Eley
*Assistant Examiner*—Khan V. Nguyen
*Attorney, Agent, or Firm*—Shapiro and Shapiro

[57] ABSTRACT

In manufacturing a metal bellows of high rigidity by using relatively simple equipment, a plurality of annular concavities are formed around the outer periphery of an unprocessed tube to form an intermediate product. Then, a core iron is inserted into the intermediate product while the annular concavities around the outer periphery are braced. Subsequently, the intermediate product is pressed in its axial direction to be formed into the metal bellows.

19 Claims, 12 Drawing Sheets

MANUFACTURING METHOD OF METAL BELLOWS

BACKGROUND OF THE INVENTION

1. Field of the Invention

The present invention relates to a method of manufacturing metal bellows built in, for example, a steering system for an automobile.

2. Related Background Art

Bellows are components which have been used for various kinds of machinery. A bellows consists of alternately formed large- and small-diameter portions, and thus its cross section in its axial direction has corrugated shape. A bellows made of metal has relatively high flexural rigidity. When a strong impact in the axial direction is given, it can collapse to absorb the energy of the impact. As the metal bellows has such characteristics, collapsible steering systems for automobiles which use metal bellows as steering columns are being developed.

A metal bellows to be built in a collapsible steering system requires to have greater rigidity than those to be used for piping, and so on, where only flexibility is required. Such metal bellows having high rigidity have been manufactured according to the methods illustrated in FIGS. 18 and 19.

The method illustrated in FIG. 18 is described in "Working Method of Piping" (M. Nakamura, Nikkan Kogyo Shinbun Pub. p96). According to this method, an unprocessed metal tube 1 is charged with high-pressure liquid, and certain portions of the unprocessed tube 1 are bulged radially outward by the pressurized liquid to form a metal bellows 2. Note that, in FIG. 18, the shape of half of the unprocessed tube 1 is shown in the lower half of the figure and that of the finished metal bellows 2 in the upper half of the figure.

In the method of FIG. 18, the unprocessed tube 1 is set inside a work cylinder 3 and charged with high-pressure liquid such as water, oil, and the like, whereby the inner peripheral surface of the tube 1 is pressed outwards to expand. At the same time, work pistons 4*a* and 4*b* engaged in respective end portions of the work cylinder 3 are strongly pressed by the pressurized liquid toward each other. Bracing rings 5 which are arranged inside the work cylinder 3 with a certain interval therebetween in the axial direction can shift inside the work cylinder 3 in the axial direction (horizontally, in FIG. 18).

When pressurized by the liquid, certain portions of the unprocessed tube 1 are expanded radially outward as shown in the upper half of FIG. 18. At the same time, the overall length of the tube 1 is reduced. As a result, the metal bellows 2, the upper half of which is shown in FIG. 18, is formed.

FIG. 19 shows another method of manufacturing a metal bellows having high rigidity, which is disclosed in Japanese Laid-Open Patent Application No. 63-157724. According to this method, a portion of the unprocessed tube 1 with respect to the axial direction is subjected to Joule heating by a high frequency induction coil 6 while the tube 1 is pressed in the axial direction. Thus, the heated portion subjected to Joule heating is plastically deformed so as to be expanded radially outwards. Then, the high frequency induction coil 6 is shifted in the axial direction by a predetermined length, and the above-mentioned process is repeated. By repeating said process several times, large-diameter portions and small-diameter portions are alternately formed to obtain a metal bellows with a corrugated cross section in the axial direction.

The above-mentioned conventional methods are subject the following problems ① and ②.

①: In the first method illustrated in FIG. 18, not only is the equipment expensive, but also it is difficult to manufacture a metal bellows which has sufficient rigidity to be used in the collapsible steering system of energy absorption type.

More specifically, as the unprocessed metal tube 1 is plastically deformed by the pressurized liquid, considerably high pressure of the liquid has to be generated. So, the hydraulic pressure generator becomes expensive. Besides, since the unprocessed tube 1 used for forming the metal bellows having high rigidity should be thick enough, it is difficult for the pressurized liquid to give sufficiently large force to plastically deform the tube 1. In addition, as liquid is used in the process, the operation is difficult to simplify and automate, thereby raising the manufacturing cost of the metal bellows.

②: In the method shown in FIG. 19, on expensive high frequency induction coil 6 is needed, which raises the cost of equipment. Also as the plurality of large diameter portions are expanded one by one, the work efficiency is not good. Therefore, also in this method, the manufacturing cost is high. Moreover, since the unprocessed tube 1 to be plastically deformed is heated, it is difficult to realize high precision in size and shape of the plastically deformed portions, which may deteriorate the overall precision of the finished metal bellows.

SUMMARY OF THE INVENTION

An object of the present invention is to provide a method of manufacturing metal bellows having high rigidity by employing relatively simple equipment.

A method of manufacturing metal bellows according to the present invention comprise the following two steps:

(a) first step in which an unprocessed cylindrical tube is prepared from a plastically mouldable metal plate, and a plurality of annular concavities are formed intermittently with respect to the direction of the axis of the tube around the entire outer periphery to obtain an intermediate product.

(b) second step in which a cylindrical core iron is inserted and fitted into the intermediate product obtained in the first step and the annular concavities are braced radially inward by a plurality of bracing members, which can shift separately from each other in the axial direction. Both ends of the intermediate product supported by the core iron and the bracing members are pressed in the axial direction to reduce the longitudinal dimension of the intermediate product as well as the intervals between the bracing members, thereby extending portions of the intermediate product between the annular concavities radially outward.

According to the above-mentioned method of manufacturing metal bellows of the present invention, a plurality of portions of the outer peripheral surface of the unprocessed tube can be cold-worked to plastically form the metal bellows by employing relatively simple manufacturing equipment.

DESCRIPTION OF THE PREFERRED EMBODIMENTS

Figure 1A:
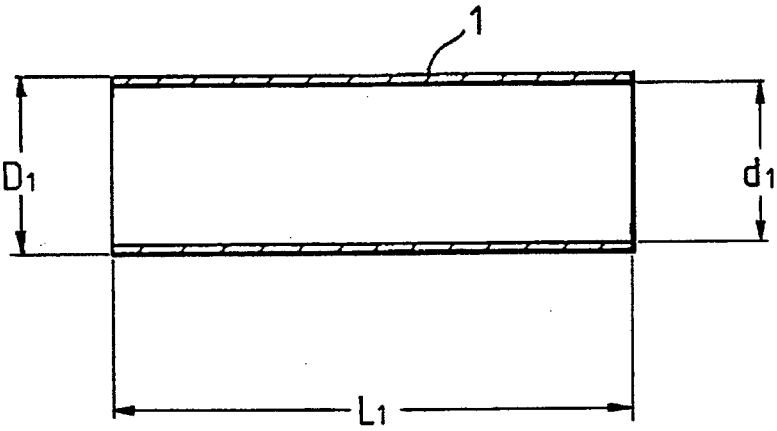
FIGS. 1A to 1F are cross-sectional views and end face views showing the shape of the material in each step, according to a first embodiment of the present invention.
Figure 1D:
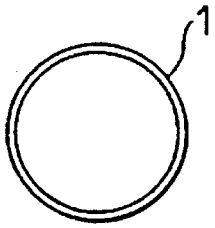

FIGS. 1A to 8 illustrate the first embodiment of the present invention. In order to manufacture a metal bellows according to this method of the present invention, an unprocessed cylindrical tube 1 as shown in FIGS. 1A and 1D is prepared from a plastically mouldable metal plate such as steel plate, stainless steel plate, or the like. The length $L_1$ of this unprocessed tube 1 is sufficiently longer than the length $L_3$ of the finished product, that is, the metal bellows 2 shown in FIGS. 1C and 1F ($L_1 >> L_3$). Also, the outer diameter $D_1$ of the unprocessed tube 1 is sufficiently smaller than the outer diameter $D_3$ of the metal bellows 2 ($D_1 << D_3$). Further, the inner diameter $d_1$ of the unprocessed tube 1 is a little larger than the inner diameter $d_3$ of the metal bellows 2 ($d_1 > d_3$). Incidentally, the thickness of the plate from which the tube 1 is prepared does not substantially change during the process.

Figure 1B:
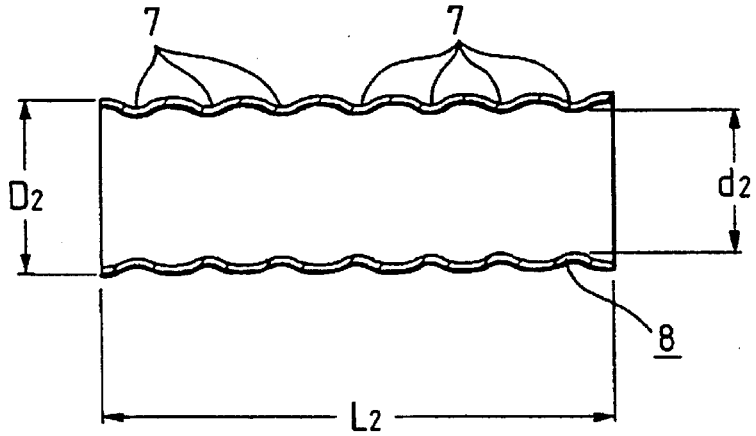
Figure 1E:
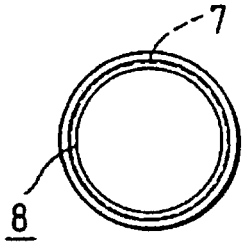

Next, in the first step, a plurality of annular concavities 7 are formed, as shown in FIGS. 1B and 1E, intermittently with respect to the direction of the axis of the tube 1 around the entire outer periphery to obtain an intermediate product 8. The length $L_2$ of this intermediate product 8 is the same as or less than the length $L_1$ of the unprocessed tube 1 ($L_1 \geqq L_2$). The outer diameter $D_2$ of the intermediate product 8 is the same as the outer diameter $D_1$ of the unprocessed tube 1 ($D_1 = D_2$) and the inner diameter $d_2$ of the intermediate product 8 is smaller than the inner diameter $d_1$ of the unprocessed tube 1 ($d_1 > d_2$).

Figure 1C:
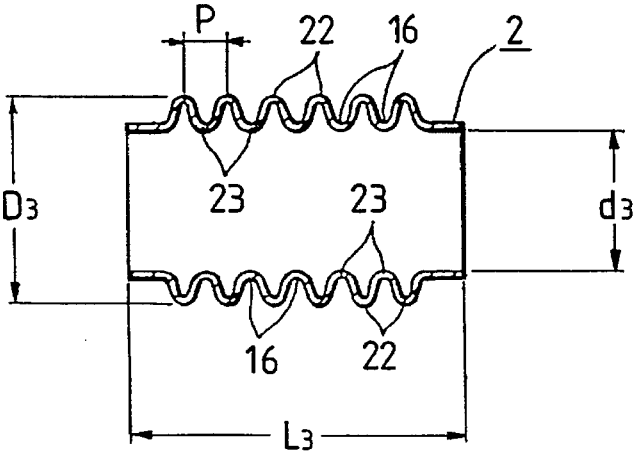
Figure 1F:
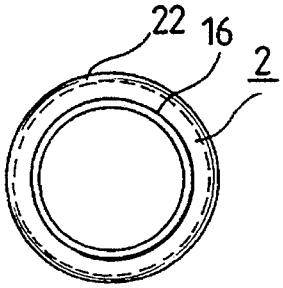

The resultant intermediate product 8 is further to be subjected to the second step to obtain the metal bellows 2 as shown in FIGS. 1C and 1F.

Figure 2:
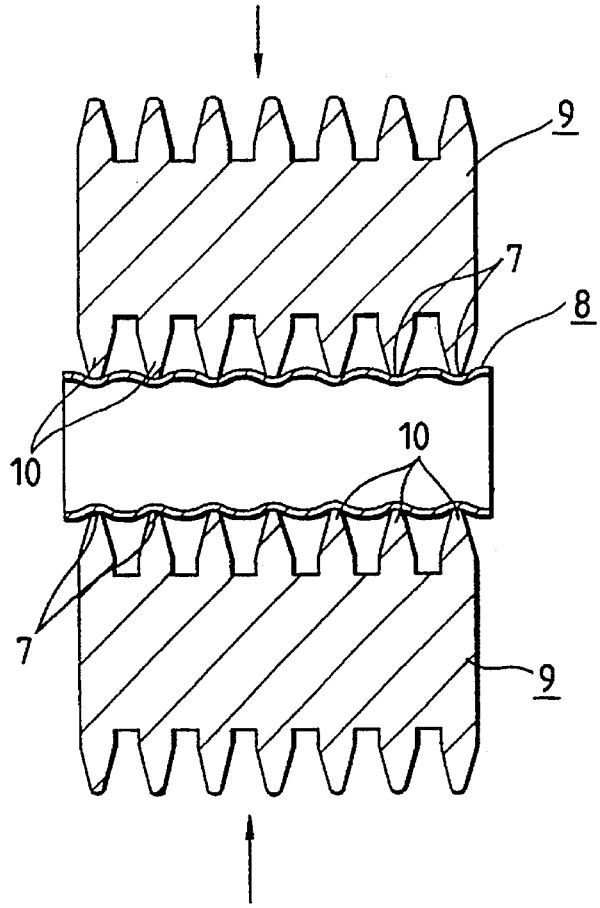
FIG. 2 is a view-showing the process in the first step of the first embodiment, wherein the cross-section is obtained when cut as indicated at A—A in FIG. 3.
Figure 3:
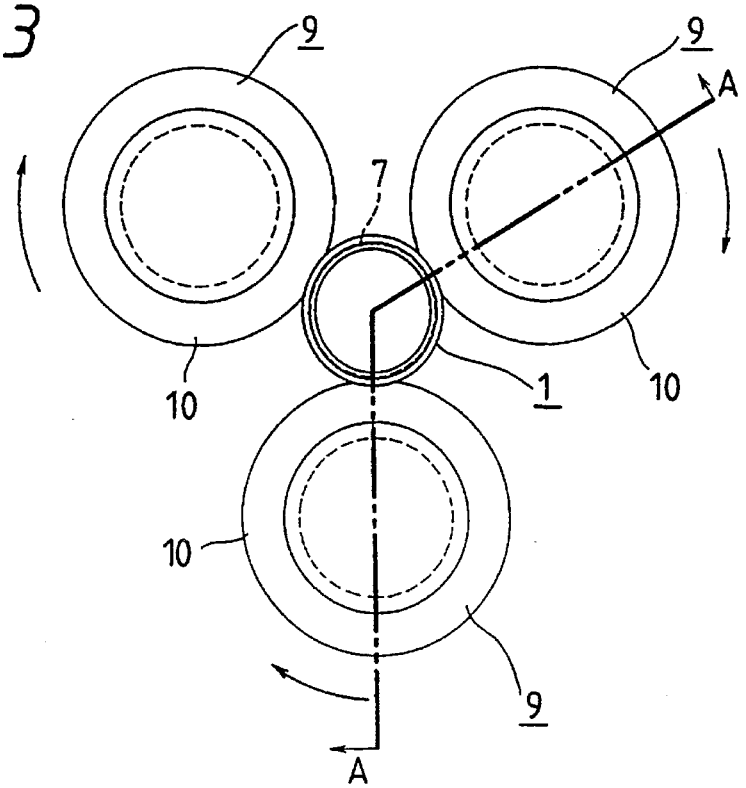
FIG. 3 is a side view of the material being processed in the first step of the first embodiment.

In the above-mentioned first step according to the present embodiment, the plurality of annular concavities 7 are formed around the outer periphery of the tube 1 by a triplet of rotating rollers 9, as shown in FIGS. 2 and 3. These rotating rollers 9 arranged around and in parallel with the tube 1 are rotated in the same direction (clockwise in FIG. 3) while pressed against the outer periphery of the tube 1. These rotating rollers 9 have around their outer peripheries a plurality of convex rings 10, whose pitches correspond to that of the annular concavities 7 to be formed. The phases of the convex rings 10 around the outer peripheries of respective rotating rollers 9 are adjusted in the axial direction (that is; the right- and left direction in FIG. 2, and the direction perpendicular to the plane of FIG. 3).

The convex rings 10 formed around the outer peripheries of these rotating rollers 9 are pressed against the outer periphery of the tube 1 while the rotating rollers 9 are rotated in the same direction. Thus, the outer periphery of the tube 1 is plastically deformed. As a result, the annular concavities 7 whose pitch corresponds to that of the convex rings 10 are formed whereby the intermediate product 8 as described before is obtained.

Figure 4:
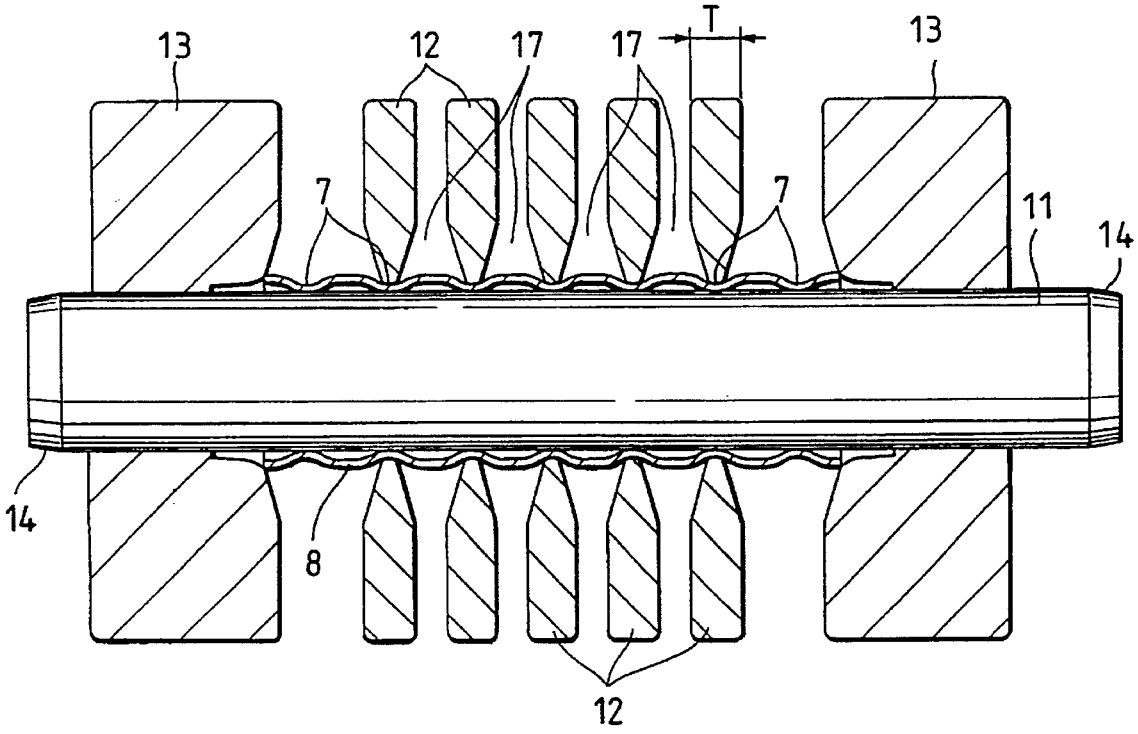
FIG. 4 is a cross-sectional view showing the state at the beginning of the second step of the first embodiment.

Next the intermediate product 8 thus formed is set in a manufacturing device as shown in FIG. 4 to be subjected to the second step to obtain the metal bellows 2 as shown in FIGS. 1C and 1F. This manufacturing device comprises: a core iron 11; a plurality of bracing rings 12 serving as bracing members; and a pair of pressure rings 13.

Note that these members 11, 12 and 13 are set in a cylindrical support tube (not shown), for example. Except one of the pressure rings 13 (for example, the right one in FIG. 4) which is fixed to the support tube, the members 12 and 13 can shift in the support tube in the axial direction. During the second step, these movable members 12 and 13 are pressed toward said fixed pressure ring 13 by, for example, a ram of a press working device, wherein all these members 12 and 13 including the fixed pressure ring 13 are supported around the core iron 11. Incidentally, according to the press working device employed, the intermediate product and the members used in the second step may be postured horizontally or vertically.

The core iron 11 penetrating said members 12 and 13 is cylindrical with a length sufficiently larger than the length $L_2$ of the intermediate product 8 and an outer diameter substantially as large as the inner diameter $d_2$ of the intermediate product 8. In order to be easily inserted into the intermediate product 8, tapered portions 14 are formed at both ends of the core iron 11.

Figure 5:
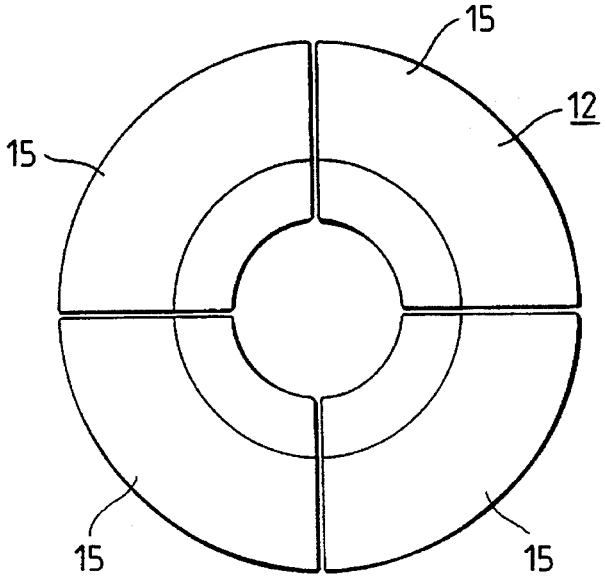
FIG. 5 is a side view of a bracing ring shown in FIG. 4.

As shown in FIG. 5, each bracing ring 12 consists of a plurality of ring components 15 (exemplified as 'four' components in FIG. 5). The arched ring components 15 constituting a ring have their cross sections near the inner peripheral edges tapered in the shape of a wedge. At the same time, the inner peripheries thereof are formed so that their radius of curvature corresponds to the outer diameter of the cross sections (seen from the axial direction) of annular recesses 16 (see FIG. 1C) to be formed between the large diameter portions 22 on the outer periphery of the finished metal bellows 2. When the ring components 15 are assembled into the bracing ring 12 and set in the above-mentioned support tube, the inner diameter of the bracing ring 12 coincides with said diameter of the cross sections of the annular concavities 7 of the intermediate product 8 (as well as with the diameter of the small portions, that is, the outer diameter of the cross sections of said annular recesses 16 of the finished metal bellows 2). Note that the inner end faces of the pressure rings 13 have the same cross-sectional shape as similarly directed faces of the bracing rings 12.

Further, according to the embodiment shown in FIG. 4, the thickness T of the bracing ring 12 consisting of the ring components 15 coincides with the pitch P (see FIG. 1C) of the annular recesses 16 around the outer periphery of the finished metal bellows 2. Therefore, there should be clearances 17 between the adjacent bracing rings 12 when the intermediate product 8 and the members 11, 12 and 13 are set in the support tube of the press working device. In this embodiment, all the annular concavities 7 except those at the end portions are surrounded by respective bracing rings 12.

Figure 6:
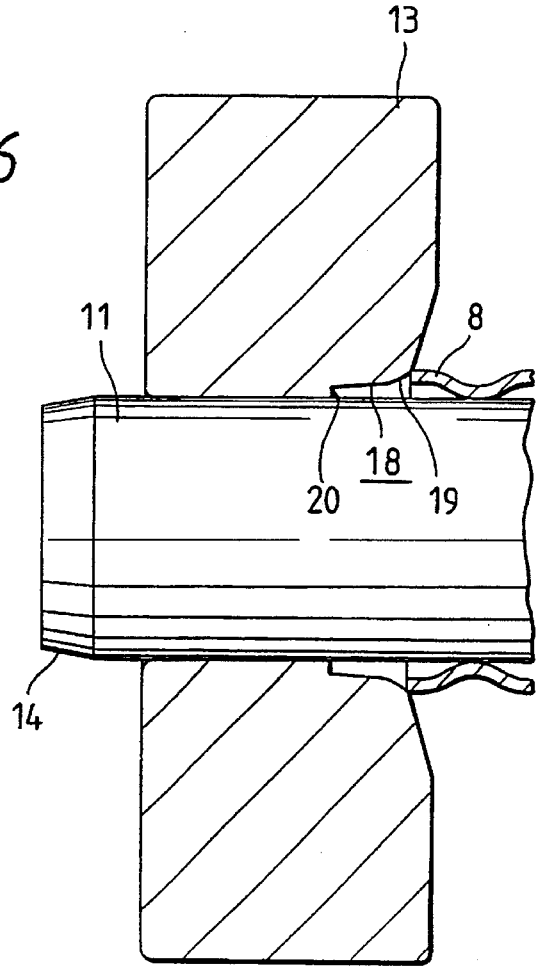
FIG. 6 is a view showing the enlarged left part of FIG. 4.
Figure 7:
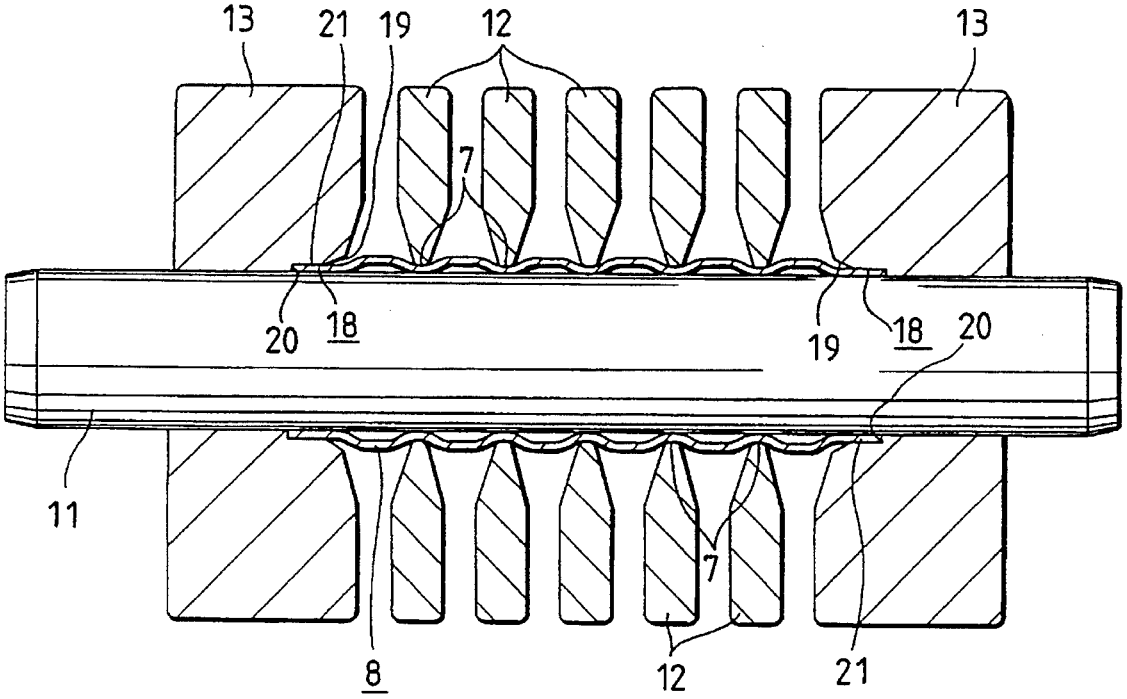
FIG. 7 is a cross-sectional view of the material being processed in the second step of the first embodiment.
Figure 8:
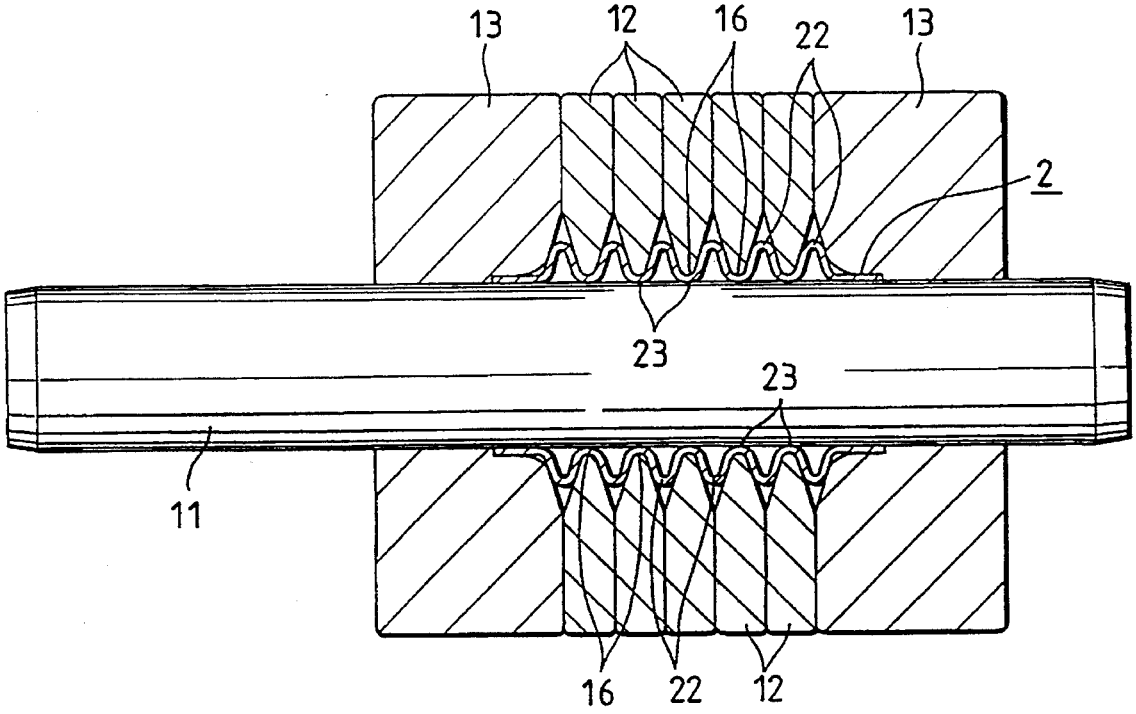
FIG. 8 is a cross-sectional view showing the state at the end of the second step of the first embodiment.

Each of the pressure rings 13 has an inner diameter a little larger than the outer diameter of the core iron. Also a step portion 18 as shown in FIG. 6 is formed in the inner periphery near the inner end face of each press ring 13. The inner diameter of the step portion 18 becomes larger near the open end (right end face in FIG. 6), serving as a tapered portion 19 for guidance, while the innermost end of the step portion 18 serves as a pressure portion 20.

After setting the intermediate product 8 together with the members 11, 12 and 13 formed and arranged as described above in the support tube, as shown in FIG. 4, the movable pressure ring 13 (at the left in the figure) is pressed toward the fixed pressure ring 13 (at the right) in the axial direction (rightward in the axial direction in the figure) in order to plastically form the intermediate product 8 into the finished metal bellows 2 as shown in FIGS. 1C and 1F.

As the distance between the pressure rings 13 is reduced, both end portions of the intermediate product 8 are guided by the tapered portions 19 for guidance and inserted into the step portions 18 of respective pressure rings 13. Then, the edge of each end portion of the intermediate product 8 is bent radially inward and becomes narrower, where the annular concavity 7 around the end portion of the intermediate product 8 receives the flexural stress and acts as the supporting point. As a result, the end portions of the intermediate product 8 are formed into cylindrical portions 21 (see FIG. 7) whose outer and inner diameters are the same as those of the end portions of the finished metal bellows 2.

When the movable pressure ring 13 is further pressed toward the fixed pressure ring to further reduce the distance therebetween, the portions between the annular concavities 7 of the intermediate product 8 buckle to be expanded radially outward. When the pressure rings 13 are further brought close to each other so that they tightly nip the plurality of bracing rings 12 (see FIG. 8), the metal bellows 2 which consists of alternately formed large diameter portions 22 and small diameter portions 23 and thus has a corrugated cross section in its axial direction is formed.

After that, the finished metal bellows 2 together with the core iron 11, the bracing rings 12 and the pressure rings 13 are taken out of the support tube. The core iron 11, the bracing rings 12 and the pressure rings 13 are removed from the workpiece to obtain the finished metal bellows 2 of the desired shape and size.

As an example of the above method, an experiment was conducted by the inventor, in which an unprocessed tube 1 made of STKM 13A (Japanese Industrial Standard; Carbon Steel Tubes for Machine Structural Purposes No. 13) with an outer diameter $D_1$ of 31.8 mm, a thickness of 1.2 mm and a length $L_1$ of 95 mm was used to form a bellows. In the first step, seven annular concavities 7 of 1.6 mm depth were formed around the unprocessed tube 1 at a pitch of 13.5 mm to form an intermediate product 8. In the second step, the resultant intermediate product 8 was formed into a metal bellows wherein: six large-diameter portions 22 having an outer diameter of 38 mm were formed at a pitch of 8 mm between small-diameter portions having an inner diameter of 26 mm; cylindrical portions 21 having an inner diameter of 26 mm were formed at both end portions, and the overall length $L_3$ became 62 mm.

Figure 9:
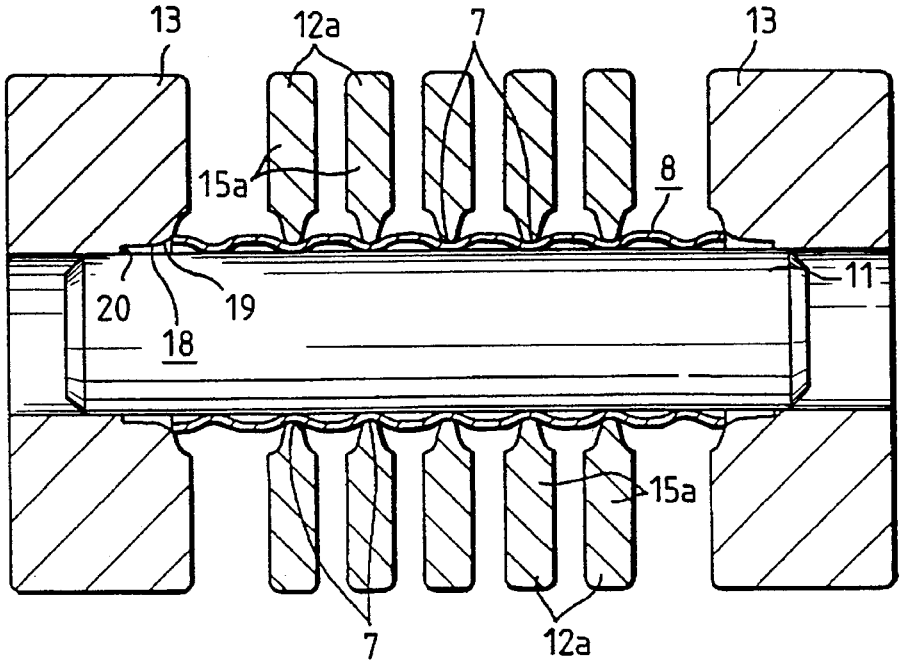
FIG. 9 is cross-sectional view showing the state at the beginning of the second step of a second embodiment of the present invention.
Figure 10:
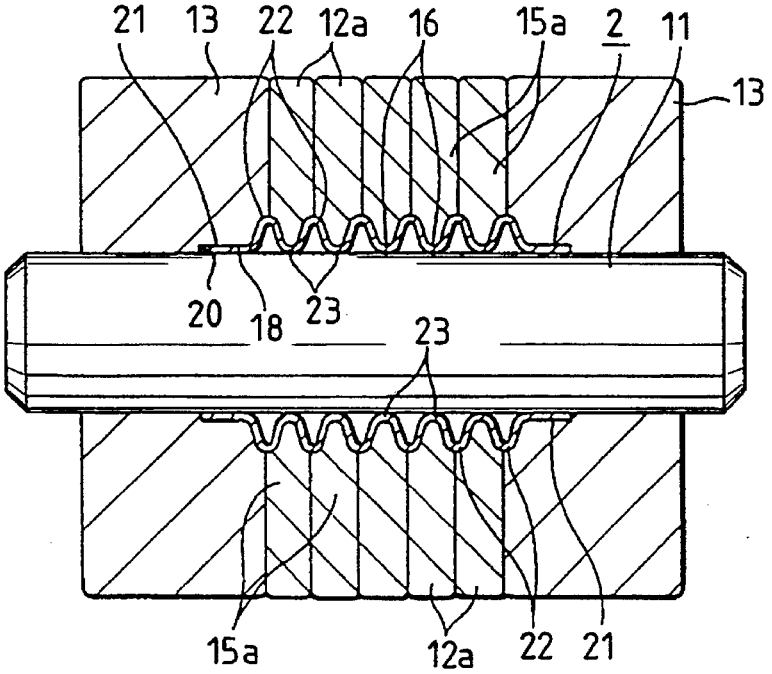
FIG. 10. Is a cross-sectional view showing the state at the end of the second step of the second embodiment.

Now, the second embodiment of the present invention will be described in connection with FIGS. 9 and 10. In this embodiment, the cross section (cut in the axial direction) of the inner peripheral edges of respective ring components **15*a* constituting the bracing ring 12*a* are shaped so as to correspond to the cross section of the outer surface of the metal bellows 2 to be manufactured. Therefore, according to this embodiment, the resultant metal bellows 2** has greater precision in its shape and size than the metal bellows formed according to the above-mentioned first embodiment. The other members employed in this embodiment are the same as those employed in the first embodiment.

Figure 11:
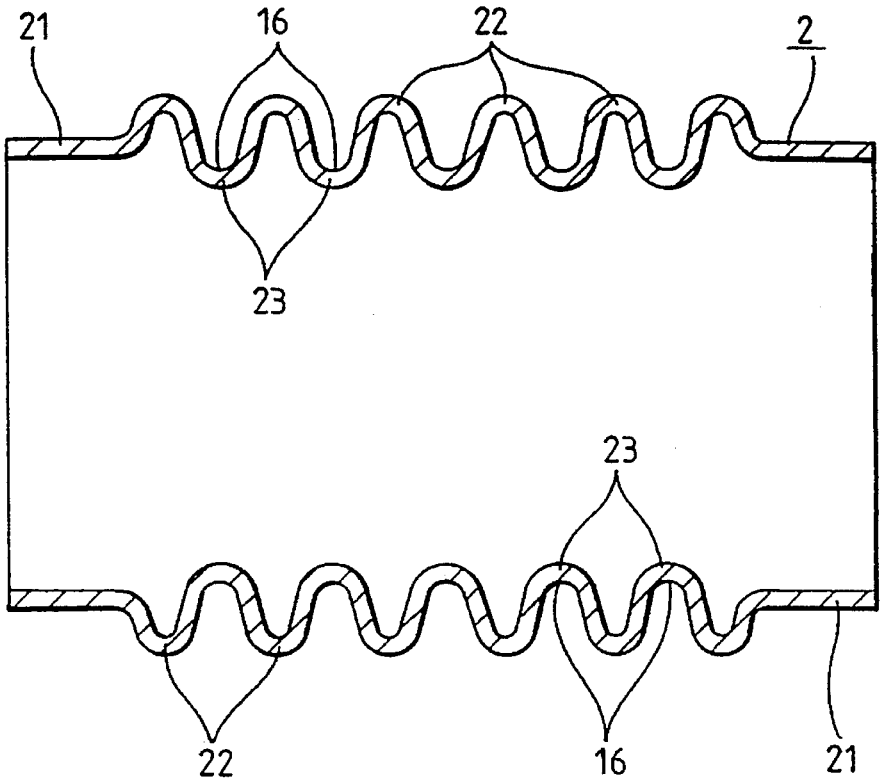
FIG. 11 is a cross-sectional view of a metal bellows manufactured according to a third embodiment of the present invention.

Next, the third embodiment of the present invention will be described in connection with FIGS. 11 to 13. In this embodiment, cylindrical portions 21 at respective end portions of the finished metal bellows 2 have a larger inner diameter than the small-diameter portions 23. In order to shape such cylindrical portions 21, two annular concavities 7, which are formed at respective end portions of the outer periphery of the intermediate product 8 according to said first embodiment, are not formed in the first step according to this embodiment.

In the second step, all the annular concavities are held by the bracing rings 12. Each inner end face of a pair of pressure rings **13*a* set at respective ends in the support tube has an annular recess which is coaxial with but a little larger than the center aperture. The end portions of the intermediate product 8 can be inserted and fitted into respective annular recesses 24**.

Figure 12:
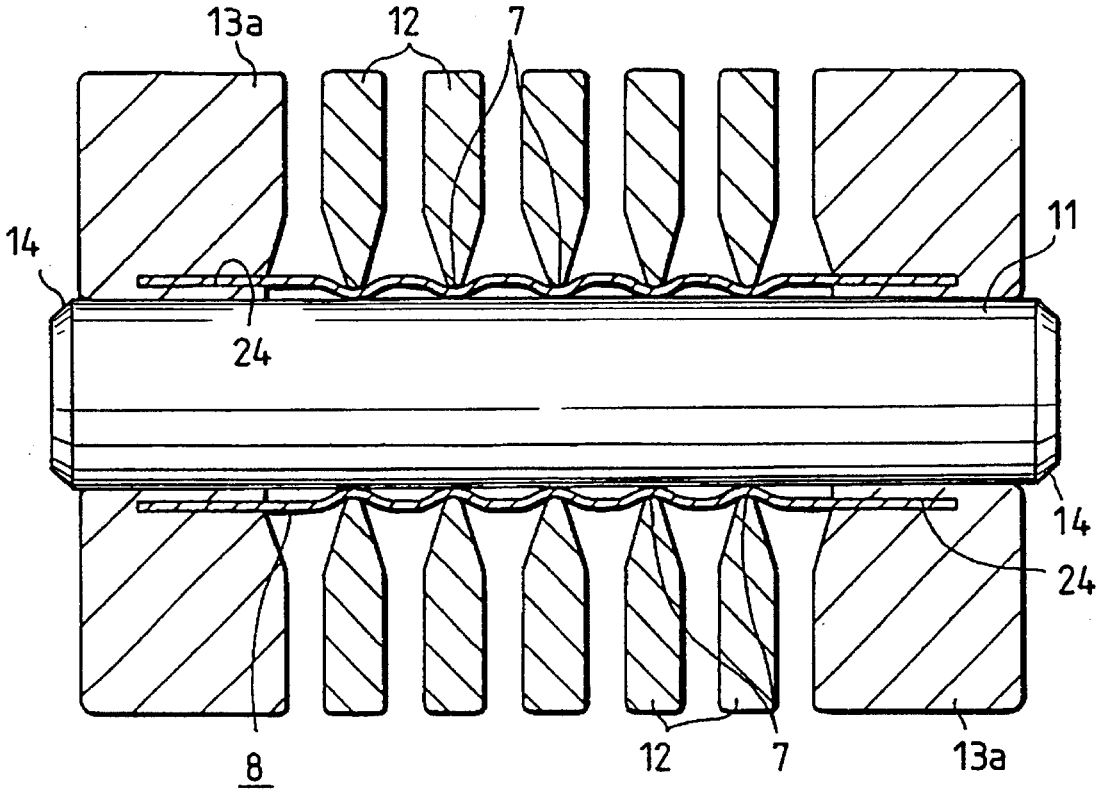
FIG. 12 is a cross-sectional view showing the material being processed in the second step of the third embodiment.
Figure 13:
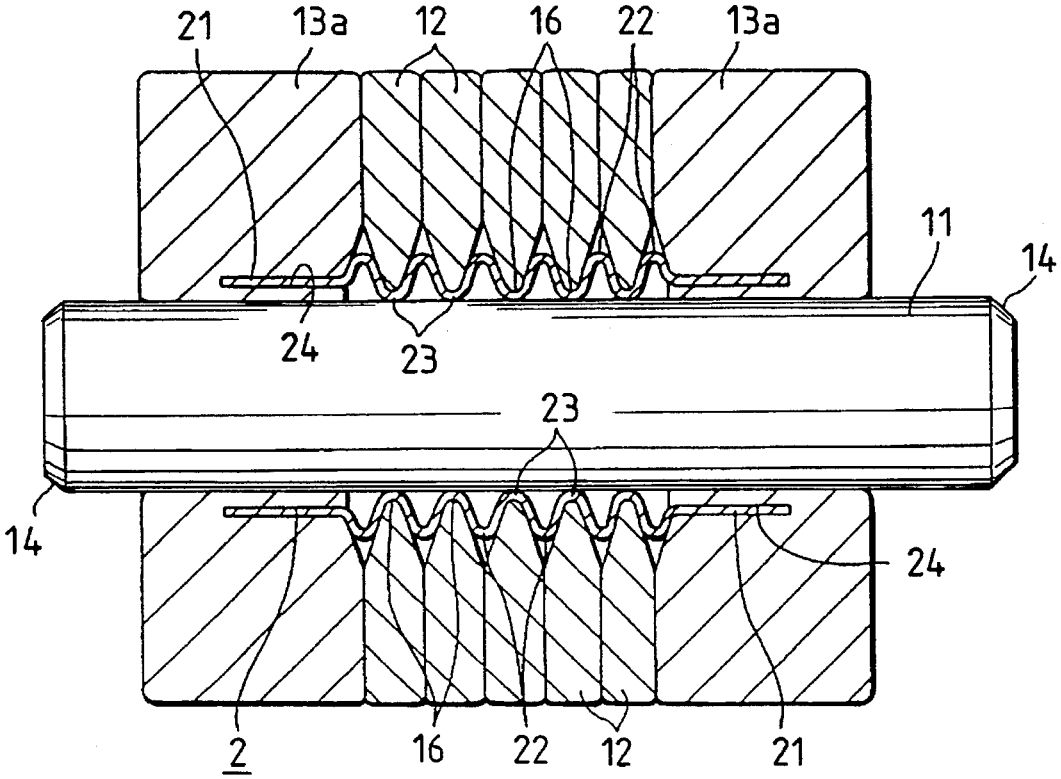
FIG. 13 is a cross-sectional view showing the state at the end of the second step of the third embodiment.

According to this embodiment, the intermediate product 8 and the members 11, 12 and **13*a* are assembled as shown in FIG. 12 and inserted into the support tube. Then, the pressure rings 13*a* are pressed toward each other as shown in FIG. 13, thereby obtaining the metal bellows 2', as shown in FIG. 11 having cylindrical portions 21 whose inner diameter is larger than that of the small-diameter portions 23**.

Figure 14:
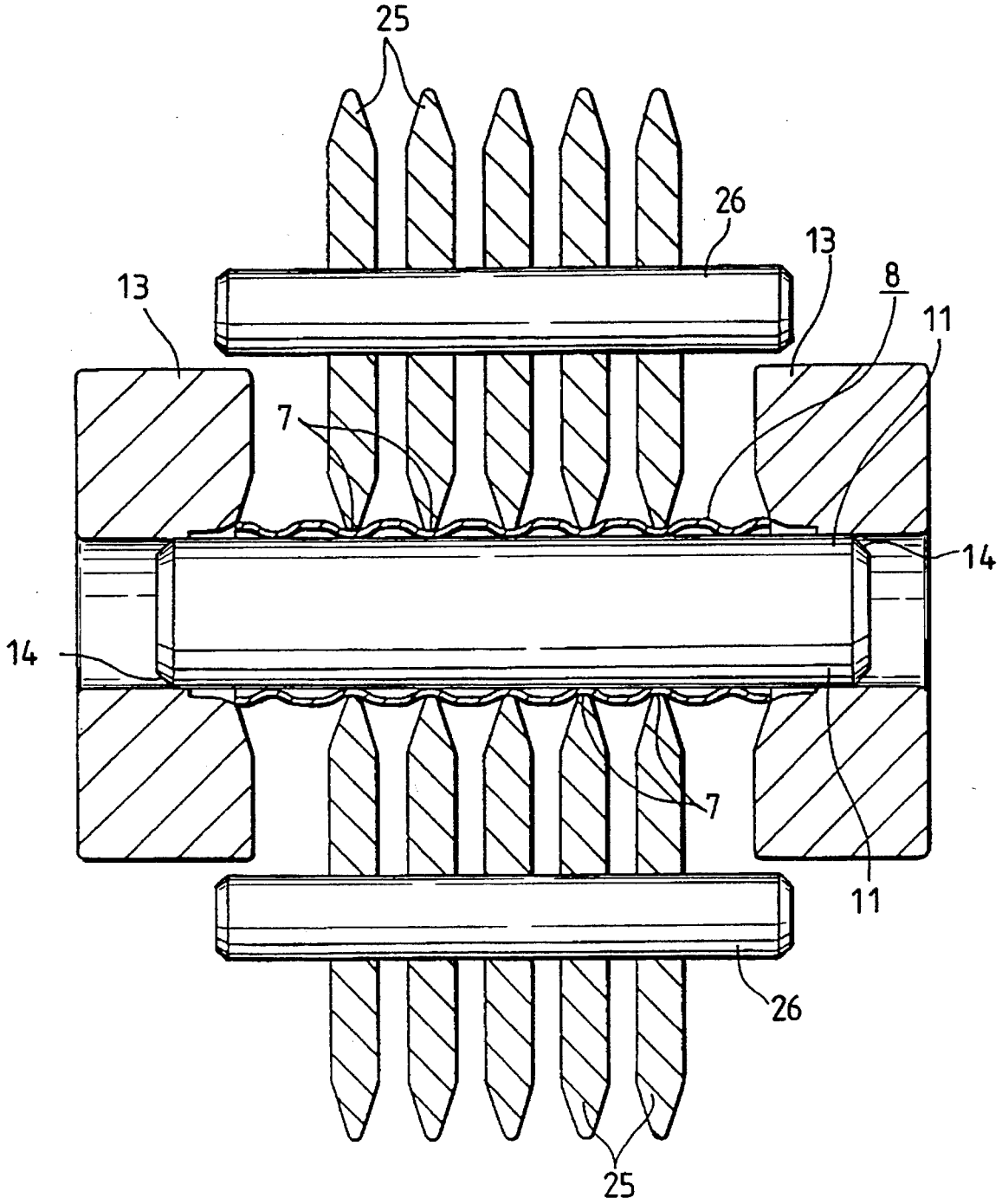
FIG. 14 is a cross-sectional view showing the material being processed in the second step of a fourth embodiment of the present invention.
Figure 15:
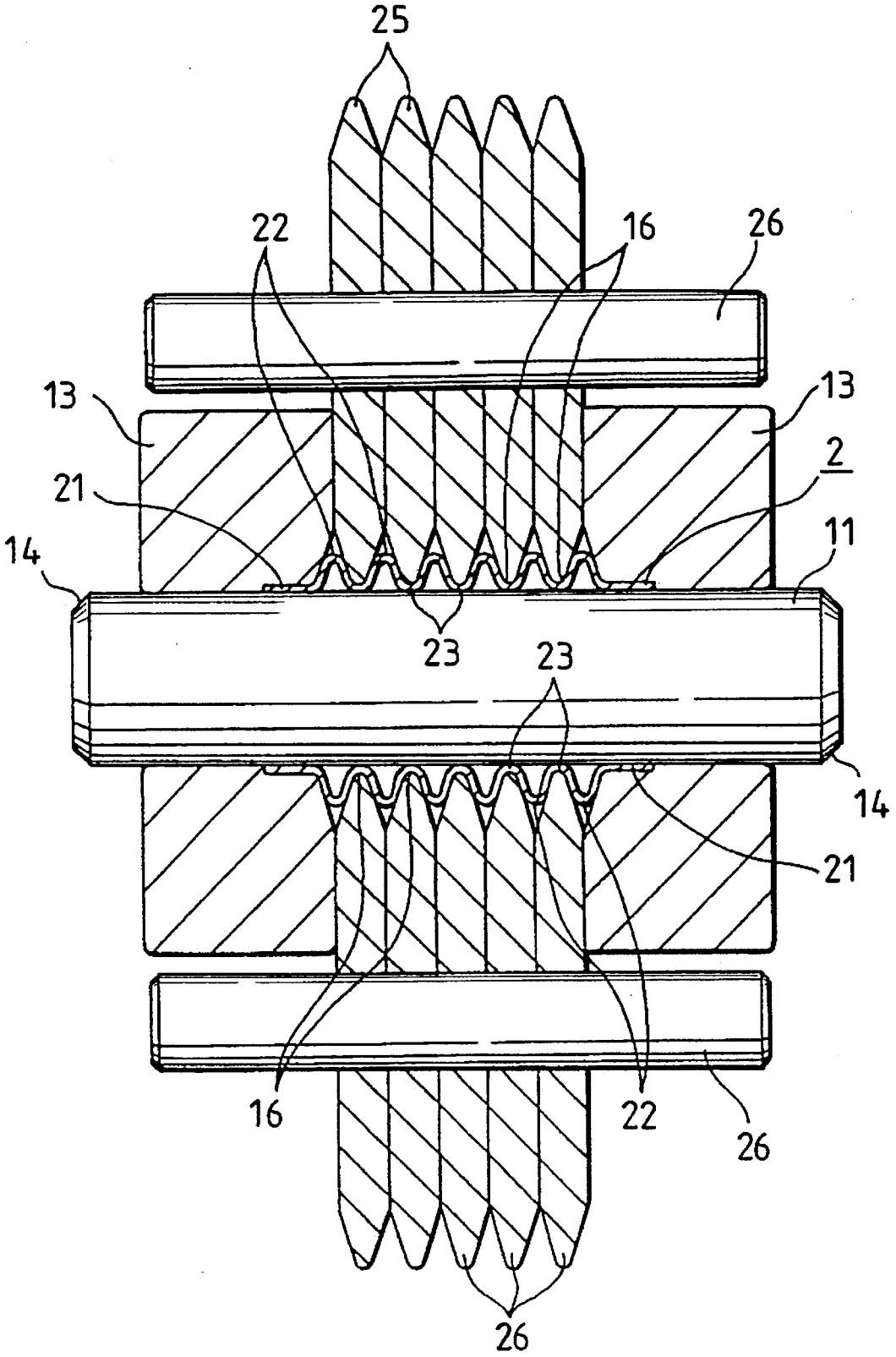
FIG. 15 is a cross-sectional view showing the state at the end of the second step of the fourth embodiment.

Next, the fourth embodiment of the present invention will be described in connection with FIGS. 14 to 16. In this embodiment discs 25 which are rotated beside the intermediate product 8 are used in the second step as the members holding the annular concavities 7 around the outer periphery of the intermediate product 8. These discs 25 are revolvably supported by shafts 26 which are arranged in parallel with the intermediate product 8. The discs 25 can shift along the shafts 26.

Figure 16:
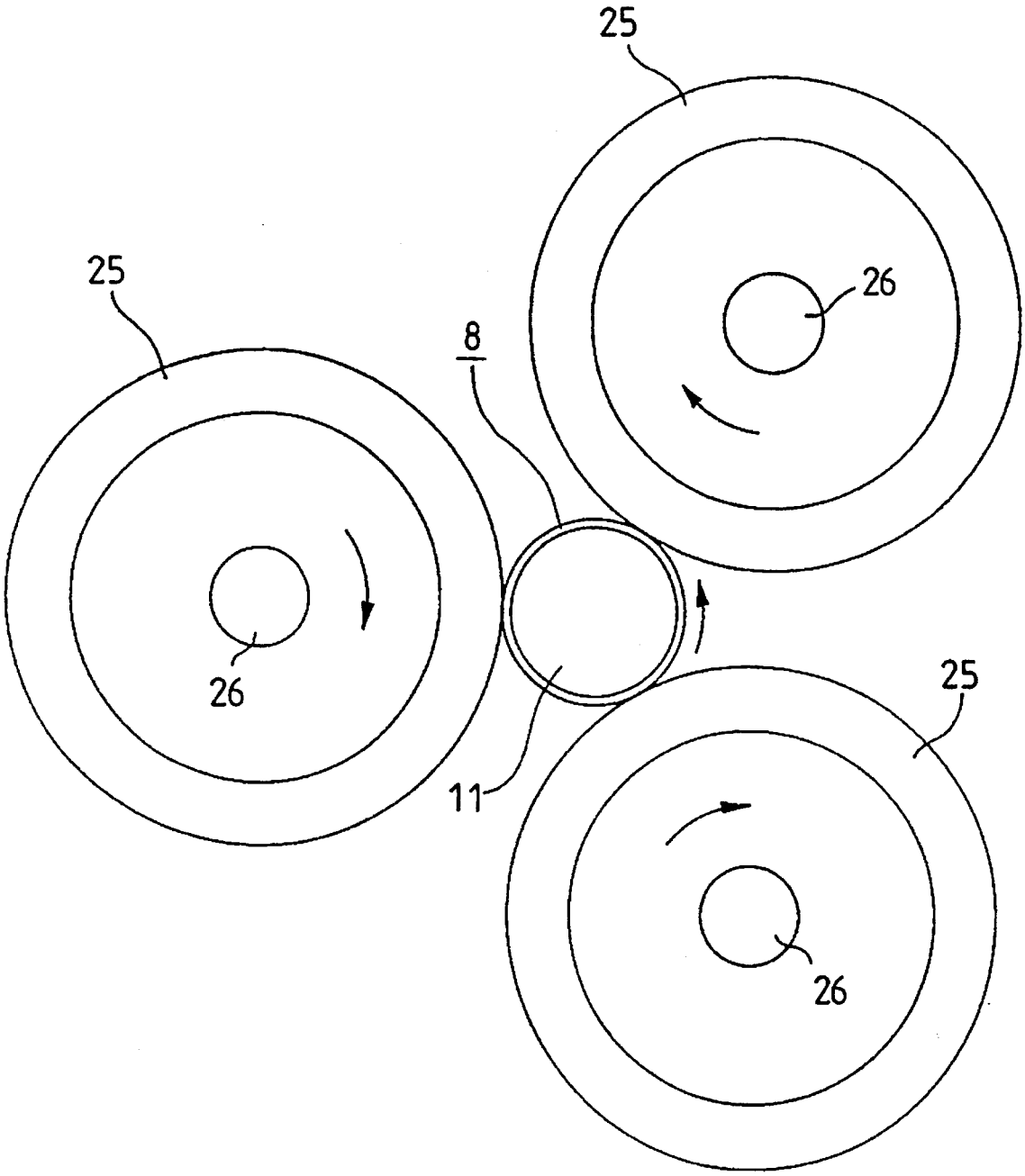
FIG. 16 is a side view of the state shown in FIGS. 14 and 15.

In the second step, the intermediate product 8 and the discs 25 are rotated in the direction indicated by the arrows in FIG. 16. At the same time, the two pressure rings 13 arranged as shown in FIG. 14 are pressed in the axial direction toward each other until the state illustrated in FIG.

15 is obtained. According to this embodiment, though the working devices are more complicated than those employed in the above-mentioned first to third embodiments, the resultant bellows 2 can have very smooth and regular shape. The finished metal bellows 2 can be taken out by drawing the shafts 26 apart from one another.

Figure 17:
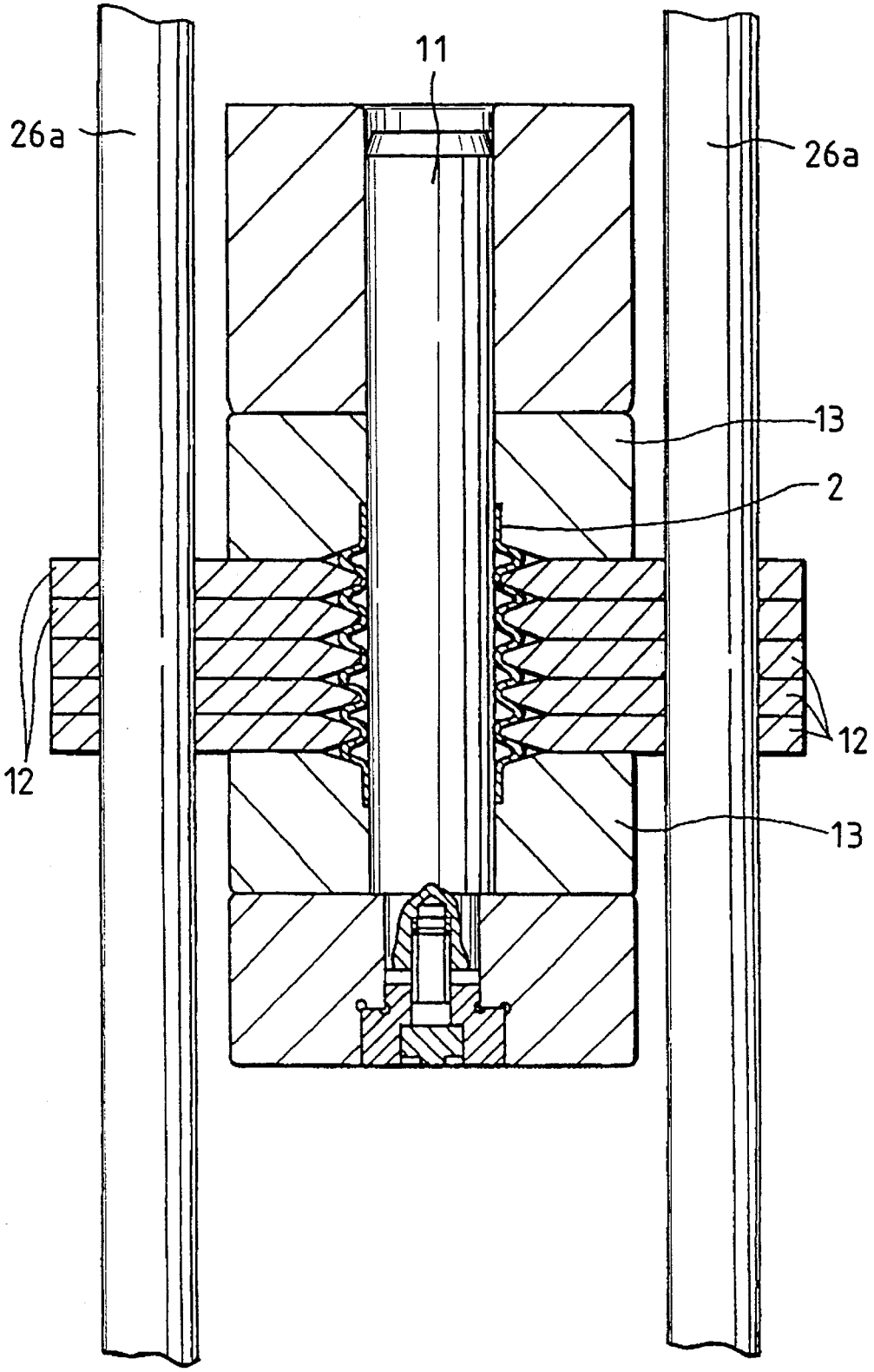
FIG. 17 is a longitudinal-sectional view showing another example of the manufacturing device in the state at the end of the second step.
Figure 18:
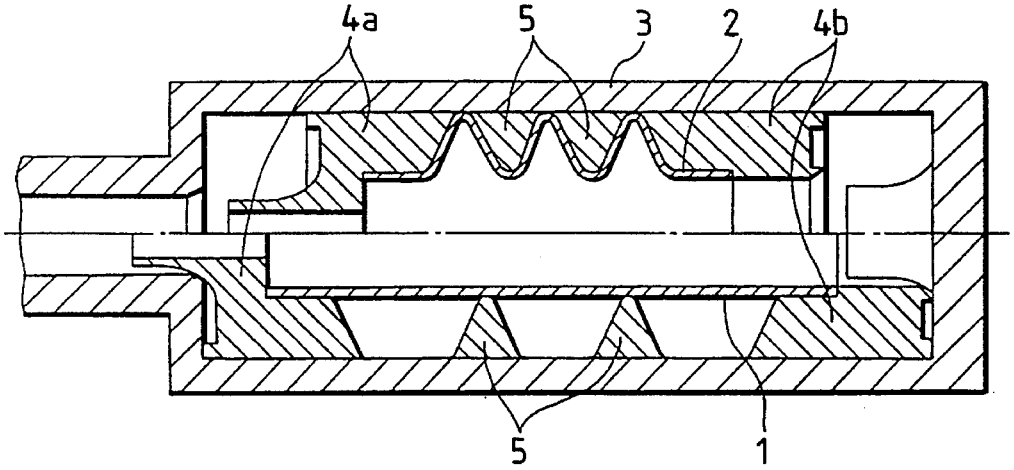
FIG. 18 PRIOR ART
FIG. 18 is a cross-sectional view showing an example of the conventional methods.
Figure 19:
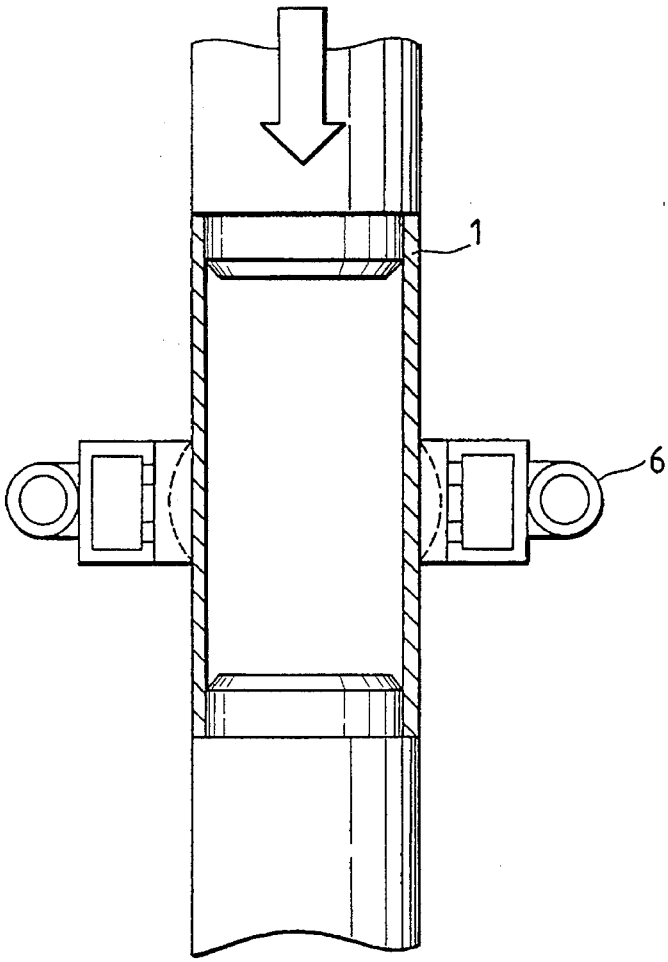
FIG. 19 PRIOR ART
FIG. 19 is cross-sectional view showing another example of the conventional methods.

Incidentally, the bracing rings 12 (12*a*) used in the first to third embodiments may be supported not only in the support tube as described before but also around shafts in the same way as the fourth embodiment described above. More specifically, as shown in FIG. 17, the outer diameter of the bracing rings 12 are enlarged to be larger than that of the pressure rings 13, and the portions of the bracing rings 12 protruding outward from the pressure rings 13 are supported by shafts 26*a*. The bracing rings 12 can shift along the shafts 26 arranged in parallel with the core iron 11. Thus, when the pressure rings 13 are pressed toward each other during the second step, the clearances between the bracing rings 12 are reduced, thereby forming the metal bellows 2. With this arrangement, the bracing rings 12 can be handled more easily than with the support tube. Accordingly, the metal bellows 2 can be manufactured more efficiently. Note that in order to take out the finished metal bellows 2, each bracing ring 12 is divided into a plurality of ring components and the shafts 26*a* retreat from each other.

It will be appreciated that by the method of manufacturing a metal bellows in accordance with the present invention described above, a metal bellows of high rigidity and high precision suitable for an automobile steering system or the like can be obtained using relatively simple and inexpensive equipment.

What is claimed is:

1. A method of manufacturing a metal bellows, comprising:

providing a plastically deformable cylindrical metal tube of predetermined length and outer diameter;

forming axially spaced, radially inwardly directed annular concavities in the tube about an entire circumference of the tube, without increasing the outer diameter of the tube between concavities;

inserting a core of outer diameter substantially equal to an inner diameter of the concavities within the tube to support the concavities from within;

bracing the concavities from a radially outward direction with respective brace members which are fitted into the concavities; and axially pressing opposite axial ends of the tube to reduce the length of the tube and deform portions of the tube between the concavities radially outwardly, while shifting brace members bracing respective concavities along an axial direction of the tube to accommodate reduction in the tube length.

2. A method according to claim 1, wherein the concavities are formed by rolling the tube.

3. A method according to claim 1, wherein, upon formation, the concavities are disposed such that opposite axial ends of the tube lie adjacent to respective concavities and wherein, in association with said pressing, said opposite ends are deformed radially inwardly to form cylindrical portions of substantially the same inner diameter as the concavities.

4. A method according to claim 3, wherein, upon formation, the concavities provide substantially continuous undulations over the entire length of the tube.

5. A method according to claim 1, wherein, during formation of the concavities and said pressing, opposite end portions of the tube are maintained in cylindrical form with inner diameter greater than an inner diameter of the concavities.

6. A method according to claim 1, wherein, upon formation, the concavities provide substantially continuous undulations in the tube.

7. A method according to claim 1, wherein, upon formation, the concavities provide substantially continuous undulations over the entire length of the tube.

8. A method of manufacturing a metal bellows, comprising:

providing a plastically deformable cylindrical metal tube of predetermined length and outer diameter;

simultaneously forming axially spaced, radially inwardly directed annular concavities in the tube about an entire circumference of the tube by rolling;

inserting a core of outer diameter substantially equal to an inner diameter of the concavities within the tube to support the concavities from within;

bracing the concavities from a radially outward direction with respective brace members which are fitted into the concavities; and axially pressing opposite axial ends of the tube to reduce the length of the tube and deform portions of the tube between the concavities radially outwardly, while shifting brace members bracing respective concavities along an axial direction of the tube to accommodate reduction in the tube length.

9. A method according to claim 8, wherein, upon formation, the concavities are disposed such that opposite axial ends of the tube lie adjacent to respective concavities and wherein, in association with said pressing, said opposite ends are deformed radially inwardly to form cylindrical portions of substantially the same inner diameter as the concavities.

10. A method according to claim 9, wherein, upon formation, the concavities provide substantially continuous undulations over the entire length of the tube.

11. A method according to claim 8, wherein, during formation of the concavities and said pressing, opposite end portions of the tube are maintained in cylindrical form with inner diameter greater than an inner diameter of the concavities.

12. A method according to claim 8, wherein, upon formation, the concavities provide substantially continuous undulations in the tube.

13. A method according to claim 8, wherein, upon formation, the concavities provide substantially continuous undulations over the entire length of the tube.

14. A method of manufacturing a metal bellows, comprising:

preparing an intermediate workpiece constituted by a length of plastically deformable cylindrical metal tubing having axially spaced, radially inwardly directed annular concavities formed about an entire circumference of the tubing by rolling;

inserting a core of outer diameter substantially equal to an inner diameter of the concavities within the workpiece to support the concavities from within;

bracing the concavities from a radially outward direction with respective brace members which are fitted into the concavities;

axially pressing opposite axial ends of the workpiece to reduce the length of the workpiece and deform portions of the workpiece between the concavities radially outwardly, while shifting brace members bracing respective concavities along an axial direction of the workpiece to accommodate reduction in the workpiece length.

15. A method according to claim 14, wherein the concavities are disposed such that opposite axial ends of the intermediate workpiece lie adjacent to respective concavities and wherein, in association with said pressing, said opposite ends are deformed radially inwardly to form cylindrical portions of substantially the same inner diameter as the concavities.

16. A method according to claim 15, wherein the concavities provide substantially continuous undulations over the entire length of the intermediate workpiece.

17. A method according to claim 14, wherein, during said pressing, opposite end portions of the workpiece are maintained in cylindrical form with inner diameter greater than an inner diameter of the concavities.

18. A method according to claim 14, wherein the concavities provide substantially continuous undulations in the intermediate workpiece.

19. A method according to claim 14, wherein the concavities provide substantially continuous undulations over the entire length of the intermediate workpiece.

* * * * *